US006789340B2

(12) United States Patent
Chasnoff

(10) Patent No.: US 6,789,340 B2
(45) Date of Patent: Sep. 14, 2004

(54) DISPLAY HOLDER FOR MOUNTING ITEMS ON FABRIC OR NON-WOVEN FIBROUS SURFACES

(75) Inventor: Paul E. Chasnoff, Evanston, IL (US)

(73) Assignee: C-Line Products, Inc., Mount Prospect, IL (US)

( * ) Notice: Subject to any disclaimer, the term of this patent is extended or adjusted under 35 U.S.C. 154(b) by 0 days.

(21) Appl. No.: 10/142,691

(22) Filed: May 9, 2002

(65) Prior Publication Data

US 2002/0189147 A1 Dec. 19, 2002

Related U.S. Application Data

(60) Provisional application No. 60/290,398, filed on May 11, 2001.

(51) Int. Cl.[7] ..... G09F 3/18; G09F 7/12

(52) U.S. Cl. ..... 40/661; 40/594; 40/611.06

(58) Field of Search ..... 40/594, 597, 611, 40/661, 661.09, 760, 765, 771, 776, 778, 611.06; 248/467

(56) References Cited

U.S. PATENT DOCUMENTS 1,863,430 A * 6/1932 Woemer, Jr. ..... 40/778
1,913,110 A * 6/1933 Engel ..... 40/778
2,030,135 A * 2/1936 Carpenter ..... 24/67 R
2,068,909 A * 1/1937 Engel ..... 40/778
2,925,675 A * 2/1960 Lumpkin ..... 40/643
4,756,106 A * 7/1988 Foster ..... 40/591
5,396,987 A * 3/1995 Temple et al. ..... 206/309
5,452,479 A * 9/1995 Mostert ..... 2/195.1
6,347,471 B1 * 2/2002 Mirza ..... 40/661

* cited by examiner

*Primary Examiner*—Brian K. Green
(74) *Attorney, Agent, or Firm*—Barnes & Thornburg

(57) ABSTRACT

A display device for flat surfaces preserves the integrity of both the display item and the mounting surface by enabling the placing the display item in the polypropylene pocket, thereby eliminating the need to tape or tack the display item to the mounting surface and either pierce the display item with a tack or remove a portion of the display item when removing the tape, and similarly, the integrity of the mounting surface is preserved because the attachment member simply grabs on to the surface, instead of being pierced by a tack or taped.

3 Claims, 2 Drawing Sheets

DISPLAY HOLDER FOR MOUNTING ITEMS ON FABRIC OR NON-WOVEN FIBROUS SURFACES

CLAIM OF PRIORITY

Priority is claimed based on U.S. Provisional Application Ser. No. 60/290,398, filed May 11, 2001 invented by Paul E. Chasnoff.

BACKGROUND OF THE INVENTION

This invention relates to a flat surface display item on a fabric or non-woven fibrous surface. The essence of this invention is the polypropylene pouch together with the hook system on the back side. Together the pouch and the hook system create a protective display that protects the insert as well as the fabric or non-woven fibrous surface. The polypropylene pouch preserves the integrity, and ensures the archivability, of the insert.

1. Field of the Invention

The present invention relates to improved mounting and display of a flat surfaced item on fabric or non-woven fibrous surfaces.

2. Description of Related Art

Presently, if one wants to post a picture or other flat surfaced item on the wall of their cubicle they either need to use a push pin, or an adhesive such as tape. Often this leads to damaging the flat-surfaced item or the fabric or non-woven fibrous surfaces. This invention improves over this practice by using a micro-hook system on the back of a polypropylene pouch whereby the displayed item is safe and clearly viewable and the fabric or non-woven fibrous surface is preserved.

BRIEF DESCRIPTION OF THE PREFERRED EMBODIMENT

The display holder for mounting items on fabric or non-woven fibrous surfaces is designed to be a convenient and inexpensive method mounting display items in one's workspace. The preferred embodiment of this product consists of two polypropylene sheets laminated together to form a display pocket. At least one attachment member is laminated to one side of the display pocket. The attachment member contains a plurality of micro-hooks that allow the display device to easily and safely attach to fabric or non-woven fiberous material.

DETAILED DESCRIPTION OF THE PREFERRED EMBODIMENT

Figure 1:
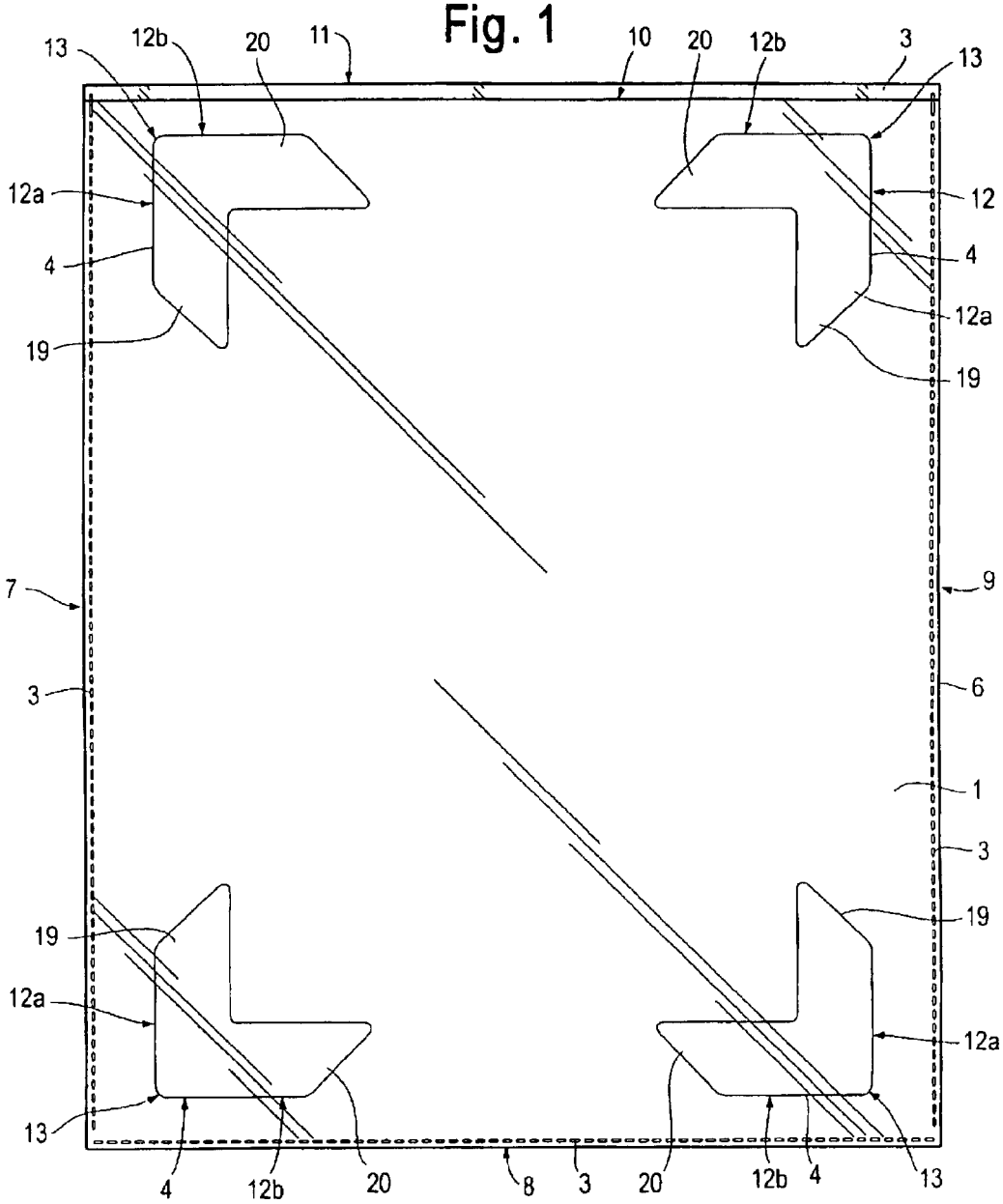
FIG. 1 is a front view of the display holder for mounting items on fabric or non-woven fibrous surfaces.
Figure 2:
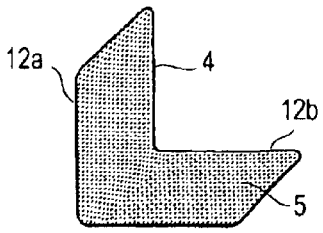
FIG. 2 is a front view of the attachment member.
Figure 3:
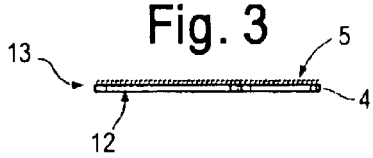
FIG. 3 is a side view of the attachment member.
Figure 4:
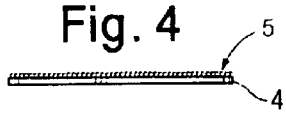
FIG. 4 is a top view of the display holder for mounting items on fabric or non-woven fibrous surfaces with the attachment member.
Figure 5:
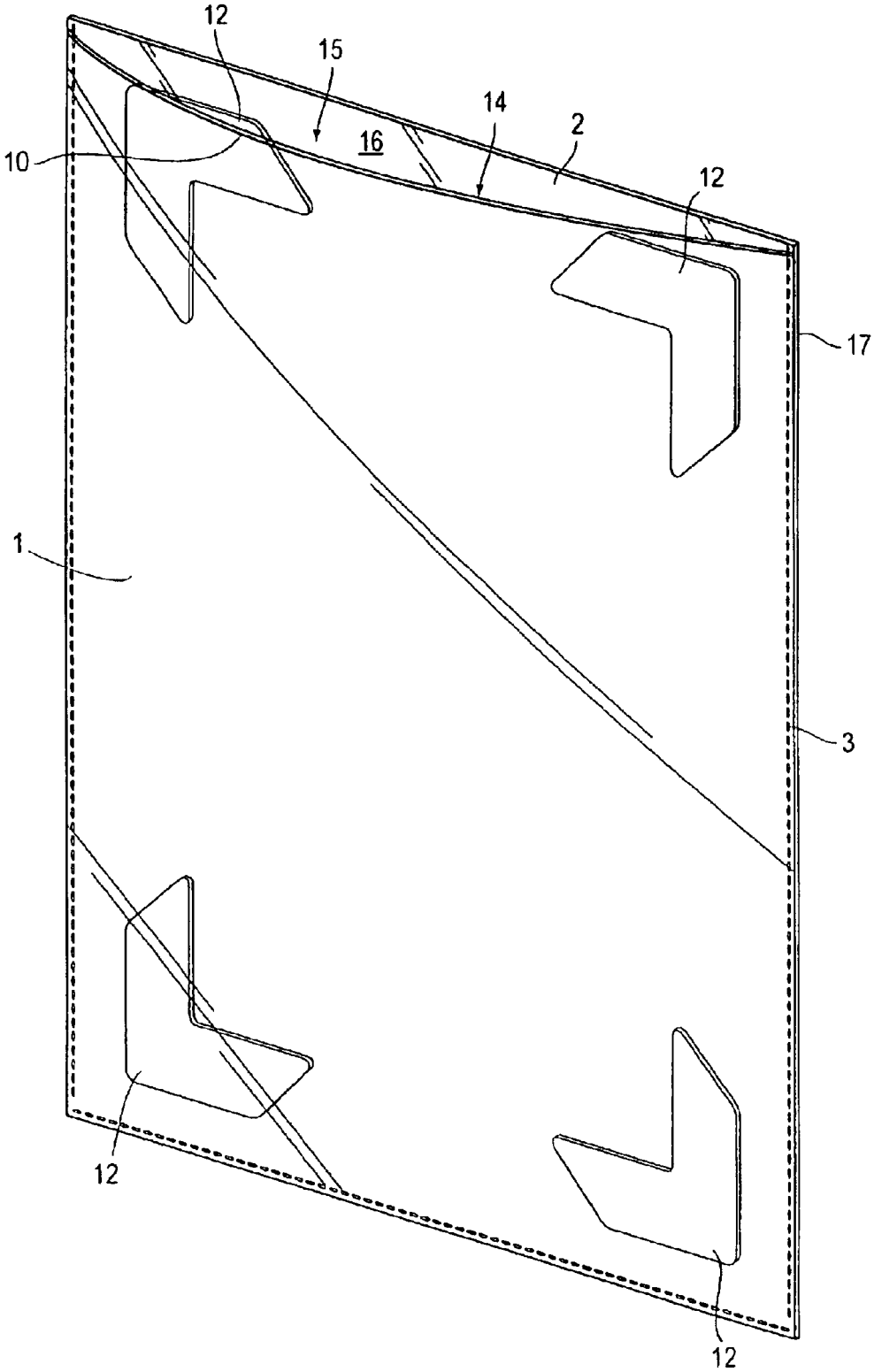
FIG. 5 is a perspective view of the display pocket.

For the purpose of promoting an understanding of the principles of the invention, references will be made to the embodiments illustrated in the drawings. It will, nevertheless, be understood that no limitation of the scope of the invention is thereby intended, such alterations and further modifications in the illustrated device, and such further applications of the principles of the invention illustrated herein being contemplated as would normally occur to one skilled in the art to which the invention relates.

A preferred embodiment of the display device 6 of the present invention is shown in FIG. 1. The display device 6 is adapted to attach to a fabric or non-woven fiberous material without damaging the display item or material. Also, in the preferred embodiment the display device 6 is made of polypropylene sheet material. The benefits of polypropylene include, but are not limited to, better archivability of a display item. Additionally, a preferred embodiment of the display device 6 uses a non-glare polypropylene. The non-glare polypropylene aids in the viewing of the display item.

Other material can be used provided it has the properties of being a foldable clear or matte material such that an object can be easily viewed from within the display device. The material is preferable capable of being thermally bonded. Additionally, the material may be smooth or textured, as adhesives certain adhesives may perform better on textured surfaces.

The display device 6 is comprised of a polypropylene display pocket 14, which consists of a top polypropylene sheet 1 and a bottom polypropylene sheet 2.

Top or first sheet 1 has left and right edges 7 and 9 and bottom edge 8. The forming of and bonding of sheets 1 and 2 are attached about edges 7, 8, 9 by various means including heat sealing, ultrasonic welding, stitch welding, or gluing, create the display pocket 14. As described above, thermal or heat sealing or welding is preferred. Sheet 1 also has a top edge 10 which is unbonded and provides a slot 15 for pocket 14. The terms 'top' and 'bottom' as used herein are relative to the figures shown.

The bottom or second polypropylene sheet 2 has a top edge 11 that extends past top edge 10 of the first polypropylene sheet 1. The extension of edge 11 of the second polypropylene sheet 2 past edge 11 of the first polypropylene sheet 1 allows for easier insertion and removal of a displayed item from the display pocket 14 through slot 15.

Sheet 2 has a front surface 16 to which sheet 1 is actually bonded, and a rear surface 17, which contacts the fabric or non-woven surface and receives fastening members 5.

An attachment member 4 consists of a exterior surface 13 and an interior surface 12. The exterior surface 13 of the attachment member 4 contains a plurality of gripping members 5 to engage the fabric or non-woven fibrous material.

This gripping member 5 may be a micro-hook, which consists of tiny plastic hooks, similar to the hooks of the hook and loop method commonly known as Velcro, a barb, a mushroom shape, or any other shape that will sufficiently grab the fabric or fibrous non-woven material. Typical is the preferred HTH 29 hook available from Velcro USA, Inc. of 406 Brown Avenue, Manchester, N.H., 03103. The hooks attach the the fibers of the surface, whether the fibers are woven to comprise a fabric, or the fibers that are formed into the non-woven fibrous material. The term "material" without further limitation refers to both the fabric material and the non-woven material.

The typical material to which the device is releasably affixed is that used as a liner or other decorative and/or sound absorbing material which is familiar to one of ordinary skill in office arrangements and applied to partitions used to divide areas and separate employees in a typical large office environment. Other similar materials can be used as a decorative wall covering applied to walls or as a wall hanging.

In the preferred embodiment, the gripping member 5 is made of plastic, however, other material may be used as long as it is malleable and strong enough to support the weight of the display device with its contained display item, and to enable removal without damage to the fabric or non-woven material described. The surface 16 of the attachment member is attached to a polypropylene sheet by various means including laminating, heat seal, stitch, weld, or glue.

In the preferred embodiment, the attachment member 5 is chevron shaped with the vertical legs 12*a* of the chevron placed aligned with sides 7 or 9 and the horizontal legs 12*b* placed aligned with bottom 8 or top 10 edge of the display device 6. The members 5 are further aligned such that the apex 13 of the chevron is pointing in the corner where the respective edges meet. Locating members 5 at the corners and using the chevron configuration further assists in maintaining sheets 1 and 2 in a generally coplanar position. This provides improved viewability and avoids sagging, particularly of sheet 1, thereby providing improved optical properties desirable when display device 6 is supporting an item such as a photograph. It will also be noted that the members in the location below slot 15 will, when pocket 14 is filled with a full size item, be concealed from view and a more pleasing appearance provided than if flanges or tabs outside the dimensions of the pocket 14 were used.

Another feature of the preferred member 5 is the treatment of ends 19 and 20 in which they are formed at an angle of about 45° and perpendicular to the axis of apex 13.

While other shapes of members 5 can provide adequate support, the chevron shape has been determined to optimize holding ability, maximize coplanar relationship between sheets, yet provide ease of removal and greater economic efficiency while enabling the above mentioned hidden property when the pocket 14 is filled.

What is claimed is:

1. A display device for attachment to a fabric or non-woven fibrous material to display an item, the display device comprising;

a polypropylene pocket consisting of a first polypropylene sheet and a second polypropylene sheet, the second polypropylene sheet having an edge extending further than the first polypropylene sheet;

said polypropylene pocket formed by joining said first and second polypropylene sheets by way of a weld;

said polypropylene pocket having an opening along a top edge thereof;

a plurality of fasteners having a plurality of micro-hooks to attach the display device to the material, said fasteners being attached to said second sheet of said polypropylene pocket by way of a lamination, said fasteners not coming in contact with said first sheet;

said polypropylene pocket being formed in a generally rectangular shape having a top, a bottom, and two sides, joined respectively by corners and arranged to display the item when said display device is removably affixed to the material;

one of said fasteners being positioned proximate each of the corners of said rectangular shape;

each of said plurality of fasteners being formed in a chevron shape having a horizontal leg, a vertical leg and an apex between the legs;

said plurality of fasteners being positioned so said horizontal legs are proximate and parallel to one of said top or said bottom of said pocket, and said vertical legs are proximate and parallel to one of said sides.

2. A display device for flat surfaces of fiber material comprising:

a transparent pocket formed by the bonding of a transparent top sheet to a front surface of a bottom sheet defining said pocket by two sides, a bottom and a top slot, the meeting point of said two sides, said bottom and said top slot forming respective intersections;

said top slot formed along the uppermost edge of said transparent pocket;

the respective intersections of said two sides, bottom and top slot comprising a plurality of corners;

said bottom sheet has a rear surfaces of fiber material for contacting the flat surface;

an attachment member affixed to said rear surface for releasably gripping said flat surfaces of fiber material, said attachment member does not come into contact with said front sheet;

said attachment member being one of a plurality of attachment members;

said plurality of attachment members being arrayed in close association with said corners;

each of said plurality of attachment members being formed in a chevron shape having a first leg, a second leg and an apex between the legs;

each said first leg is aligned with one of said sides and each said second leg is aligned with one of said top slot or said bottom.

3. The device of claim 2 further comprising:

each of said attachment members being formed of a material having a plurality of micro-gripping members arrayed on its surface for contacting and engaging said fiber material.

* * * * *